US012144450B1

(12) United States Patent
Hao

(10) Patent No.: US 12,144,450 B1
(45) Date of Patent: Nov. 19, 2024

(54) THREE-JOINT LINKAGE LIFTING DEVICE WITH A BUILT-IN CHAIN FOR CHRISTMAS TREE

(71) Applicant: KING TREE HANDICRAFTS (SHENZHEN) CO., LTD., Shenzhen (CN)

(72) Inventor: Xiaopeng Hao, Tianjin (CN)

(73) Assignee: KING TREE HANDICRAFTS (SHENZHEN)CO., LTD., Shenzhen (CN)

( * ) Notice: Subject to any disclaimer, the term of this patent is extended or adjusted under 35 U.S.C. 154(b) by 0 days.

(21) Appl. No.: 18/204,434

(22) Filed: Jun. 1, 2023

(51) Int. Cl.
*A47G 33/12* (2006.01)

(52) U.S. Cl.
CPC ..... *A47G 33/12* (2013.01); *A47G 2033/122* (2013.01)

(58) Field of Classification Search
CPC ..... A47G 33/12; A47G 2033/122
USPC ..... 248/219, 121, 158
See application file for complete search history.

(56) References Cited

U.S. PATENT DOCUMENTS 2,904,292 A * 9/1959 Clouthier ..... A47G 33/12 248/524
5,704,669 A * 1/1998 Clark ..... B25J 1/04 294/24
6,343,568 B1 * 2/2002 McClasky ..... A01K 31/14 119/428
9,577,376 B1 * 2/2017 Tsai ..... H01R 13/629
9,883,706 B2 * 2/2018 Chen ..... A47G 33/06
10,801,229 B1 * 10/2020 George, Sr. ..... E04H 12/32
11,552,365 B2 * 1/2023 Williams ..... F16M 11/36
2001/0025393 A1 * 10/2001 Nicolette ..... E04D 13/0765 15/160
2005/0048226 A1 * 3/2005 Gary ..... A47G 33/06 428/18
2011/0255929 A1 * 10/2011 Buchner ..... B25H 1/0035 408/137
2012/0276307 A1 * 11/2012 Schooley ..... A47G 33/12 29/401.1
2013/0308301 A1 * 11/2013 Chen ..... F21S 4/10 362/123
2014/0287618 A1 * 9/2014 Chen ..... F21S 4/10 439/527
2015/0000746 A1 * 1/2015 Peterson ..... A01G 27/008 137/558
2015/0041613 A1 * 2/2015 Ray ..... A47G 33/12 248/519

(Continued)

*Primary Examiner* — Muhammad Ijaz
(74) *Attorney, Agent, or Firm* — Birchwood IP

(57) ABSTRACT

A three-joint linkage lifting device with built-in chain for Christmas tree, comprising an outer tube, a middle tube, an inner tube, an upper fixing sleeve for the outer tube, an upper fixing sleeve for the middle tube, a lower fixing sleeve for the inner tube, an electric lifting assembly, and a sliding hoisting rope, wherein the Christmas tree lifting bracket is configured to be an electric two-stage lifting bracket, and the components of the Christmas tree are sleeved outside the bracket, so that the Christmas tree bracket can be lifted and lowered by pushing the screw linear pushing device of the electric lifting assembly, the sliding hoisting rope is fixed on the electric lifting assembly, and when the middle tube rises, the sliding hoisting rope is jacked up to slide and pull up the inner tube synchronously.

5 Claims, 2 Drawing Sheets

(56) References Cited

U.S. PATENT DOCUMENTS

| | | | | |
|---|---|---|---|---|
| 2016/0001438 | A1* | 1/2016 | Buchner | B25H 1/0035 248/669 |
| 2016/0022081 | A1* | 1/2016 | Cooke | A47G 33/126 248/521 |
| 2017/0135511 | A1* | 5/2017 | Schooley | A47G 33/12 |
| 2017/0196391 | A1* | 7/2017 | Schooley | A47G 33/06 |
| 2018/0028009 | A1* | 2/2018 | Ocegueda Gallaga | A47G 33/12 |
| 2020/0234904 | A1* | 7/2020 | McRae | H01H 71/002 |
| 2020/0305570 | A1* | 10/2020 | Zuo | B62J 9/10 |
| 2021/0115691 | A1* | 4/2021 | Williamson | E04H 12/18 |
| 2023/0081805 | A1* | 3/2023 | Hao | H01R 13/512 439/252 |
| 2024/0206662 | A1* | 6/2024 | Ocegueda Gallaga | A47G 33/12 |

* cited by examiner

THREE-JOINT LINKAGE LIFTING DEVICE WITH A BUILT-IN CHAIN FOR CHRISTMAS TREE

TECHNICAL FIELD

The present application relates to the technical field of Christmas tree devices, in particular to a three-joint linkage lifting device with built-in chain for Christmas tree.

BACKGROUND

Christmas is a traditional western festival, and it is a very widespread festival around the world. Christmas trees are essential. The Christmas tree is mainly used to decorate the active atmosphere at Christmas, and it is a commonly used decorative item for families and businesses during the Christmas period. With the rapid growth of social and economic development, more and more families and businesses buy Christmas trees as store decorations. There are also certain requirements for the height of the Christmas tree, which is not conducive to handling, and a lifting function needs to be designed.

Now it is necessary to solve the problem of the height of the Christmas tree, and there are also designed Christmas trees that can be lifted. As shown in the publication number CN217285387U patent "a new type of automatic lifting Christmas tree bracket", the bracket has only one section of telescopic design, and the height and volume after retracting are still relatively large, which is not conducive to moving and transporting. Therefore, it is necessary to further design the lifting Christmas tree support to further reduce the height and volume.

SUMMARY

In view of this, the present application provides a three-joint linkage lifting device with built-in chain for Christmas tree. Aiming at the problems in the prior art, an electric two-stage lifting system is designed to solve the existing technical problems.

The purpose of the present application is achieved through the following technical solutions:

A three-joint linkage lifting device with built-in chain for Christmas tree, comprises a base and a bracket fixed on the base, wherein the bracket comprises an outer tube, a middle tube, an inner tube, an upper fixing sleeve for the outer tube, an upper fixing sleeve for the middle tube, and a lower fixing sleeve for the inner tube, an electric lifting assembly, and a sliding hoisting rope, wherein the outer tube, the middle tube, and the inner tube are all hollow rods, a bottom of the outer tube is fixed on the base, and the upper fixing sleeve of the outer tube is fixed on a top end of the outer tube, the middle tube passes through the upper fixing sleeve for the outer tube and is slidably fitted in a central cavity of the outer tube, the upper fixing sleeve for the middle tube is fixed on a top end of the middle tube, and the inner tube passes through the upper fixing sleeve for the middle tube and is slidably fitted in a central cavity of the middle tube, and the lower fixing sleeve for the inner tube is fixed at a lower end of the inner tube and is slidably arranged on inner side of an inner wall of the cavity of the middle tube;

a power part of the electric lifting assembly is fixed on the inside of the bottom of the outer tube, a lifting stroke part of the electric lifting assembly extends into the inside of the inner tube, and a bottom of the middle tube is fixedly connected to the lifting stroke part of the electric lifting assembly, and the electric lifting assembly is electrically connected to an external control power supply system;

one end of the sliding hoisting rope is fixed at a bottom of the electric lifting assembly, and the other end passes through a top end of the electric lifting assembly and is folded back and fixed on middle and lower inner wall of the inner tube after being resisted.

Further, the electric lifting assembly is a screw linear pushing device.

Further, the screw linear pushing device comprises a motor, a motor fixing plate, a coupling, a screw-rod clamp spring, a bearing, a screw-rod fixing plate, a screw rod, a screw-rod lifting plate, a fixing tube, an upper fixing plate, a lifting tube, a lifting plate, wherein an outer side of the motor fixing plate is fixed on an inner side of a bottom end of the outer tube, the motor is fixed in middle of the motor fixing plate, and a bottom of the screw-rod is dynamically connected to a power output shaft of the motor through the coupling;

an outer side of the screw-rod fixing plate is fixed on an inner side of the bottom end of the outer tube, the upper fixing plate is fixed on the screw-rod fixing plate through the fixing tube, wherein after outer sides of an upper end and a lower end of the screw-rod are respectively fixedly sleeved with bearings and screw clamp springs, the lower end of the screw-rod can be rotatably fixed on a middle part of the screw-rod fixing plate, and the upper end of the screw-rod can be rotatably fixed on a middle part of the upper fixing plate;

an inner side of the screw-rod lifting plate is provided with an internal thread corresponding to an external thread of the screw-rod, the screw-rod passes through the screw-rod lifting plate and is screwed with it, and an upper part of the screw-rod lifting plate is fixedly connected with the bottom of the middle tube;

a bottom end of the lifting tube is fixed on the screw-rod fixing plate, and an upper end passes through the upper fixing plate and is fixedly connected with the lifting plate; one end of the sliding hoisting rope is fixed on the screw-rod fixing plate, and the other end of the sliding hoisting rope passes through the lifting tube, the upper fixing plate and the lifting plate and returns to the inner tube and is fixed on middle and lower part of the inner tube.

Further, the screw-rod linear pushing device also comprises an upper limit switch, a lower limit switch, wherein the upper limit switch is fixed on a side of the upper fixing plate facing downward, and the lower limit switch is fixed on a side of the screw-rod fixing plate facing upward and facing a bottom surface of the screw-rod lifting plate, the upper limit switch is connected in series with the lower limit switch through a wire passing through an inner cavity of the inner tube, and the motor is connected in series with the upper limit switch and the lower limit switch and then electrically connected to the external control power supply system.

Further, the sliding hoisting rope is a nylon rope, a steel wire rope or a chain.

The beneficial effect of the present application is:

In the present application, the Christmas tree lifting bracket is configured to be an electric two-stage lifting bracket, and the components of the Christmas tree are sleeved outside the bracket, so that the Christmas tree bracket can be lifted and lowered by pushing the screw linear pushing device of the electric lifting assembly, at the same time, the sliding hoisting rope is fixed on the electric lifting assembly, and when the middle tube rises, the sliding hoisting rope is jacked up to slide and pull up the inner tube synchronously, so as to achieve the effect of double joint linkage and realize the synchronous lifting of the inner tube. Through this design, the lifting speed is faster, and the height and volume are smaller after being retracted, which is convenient for transportation and arrangement.

Reference signs: 1. Base, 2. Outer tube, 3. Middle tube, 4. Inner tube, 5. Upper fixing sleeve for outer tube, 6. Upper fixing sleeve for middle tube, 7. Lower fixing sleeve for inner tube, 8. Electric lifting assembly, 9. Sliding hoisting rope, 801. Motor, 802. Motor fixing plate, 803. Coupling, 804. Screw-rod clamp spring, 805. Bearing, 806. Screw-rod fixing plate, 807. Screw rod, 808. Screw rod lifting plate, 809. Fixing tube, 810. Upper fixing plate, 811. Lifting tube, 812. Lifting plate, 813. Upper limit switch, 814. Lower limit switch.

DETAILED DESCRIPTION

Embodiments of the present disclosure will be described in detail below in conjunction with the accompanying drawings.

Embodiments of the present disclosure are described below through specific examples, and those skilled in the art can easily understand other advantages and effects of the present disclosure from the contents disclosed in this specification. Apparently, the described embodiments are only some of the embodiments of the present disclosure, not all of them. The present disclosure can also be implemented or applied through different specific implementation modes, and various modifications or changes can be made to the details in this specification based on different viewpoints and applications without departing from the spirit of the present disclosure. It should be noted that, in the case of no conflict, the following embodiments and features in the embodiments can be combined with each other. Based on the embodiments in the present disclosure, all other embodiments obtained by persons of ordinary skill in the art without making creative efforts belong to the protection scope of the present disclosure.

In order to realize the multi-stage lifting of the Christmas tree and further reduce the height and volume, the specific content of this application is as follows.

Figure 1:
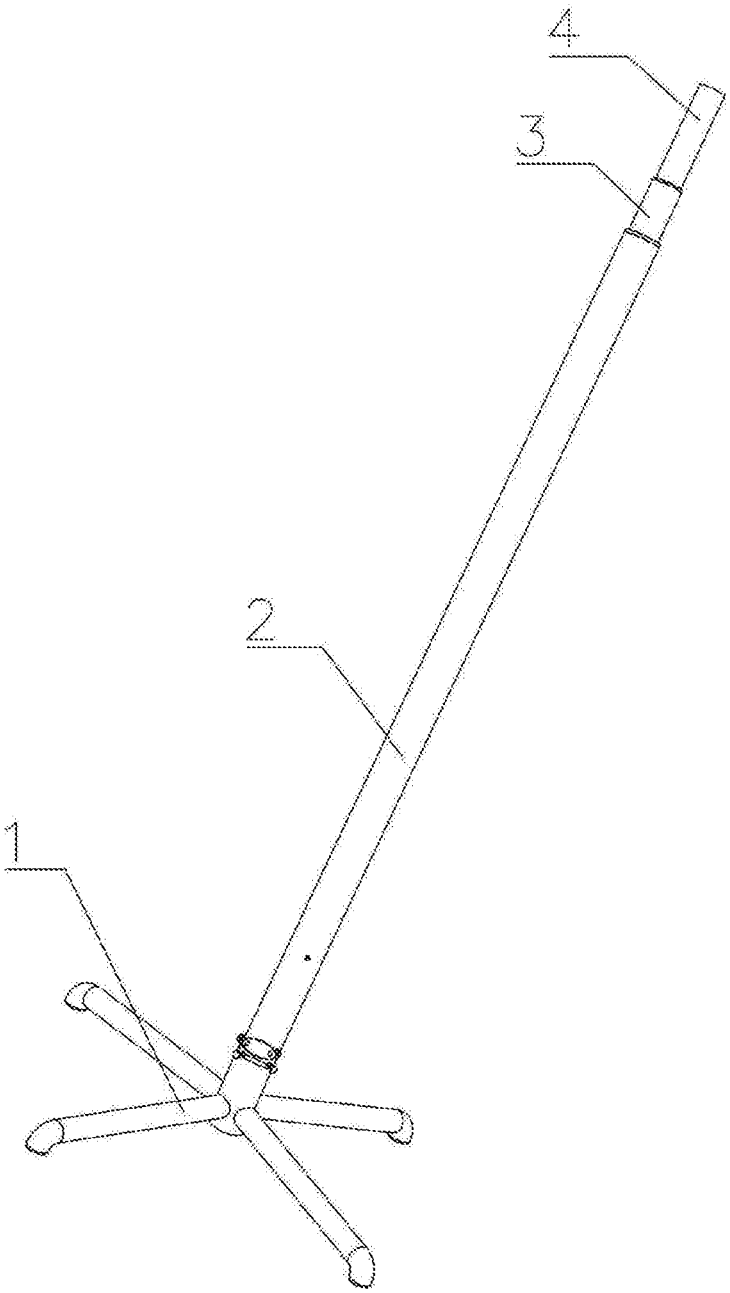
FIG. 1 is the schematic diagram of the three-joint linkage lifting device with built-in chain for Christmas tree in the present application.
Figure 2:
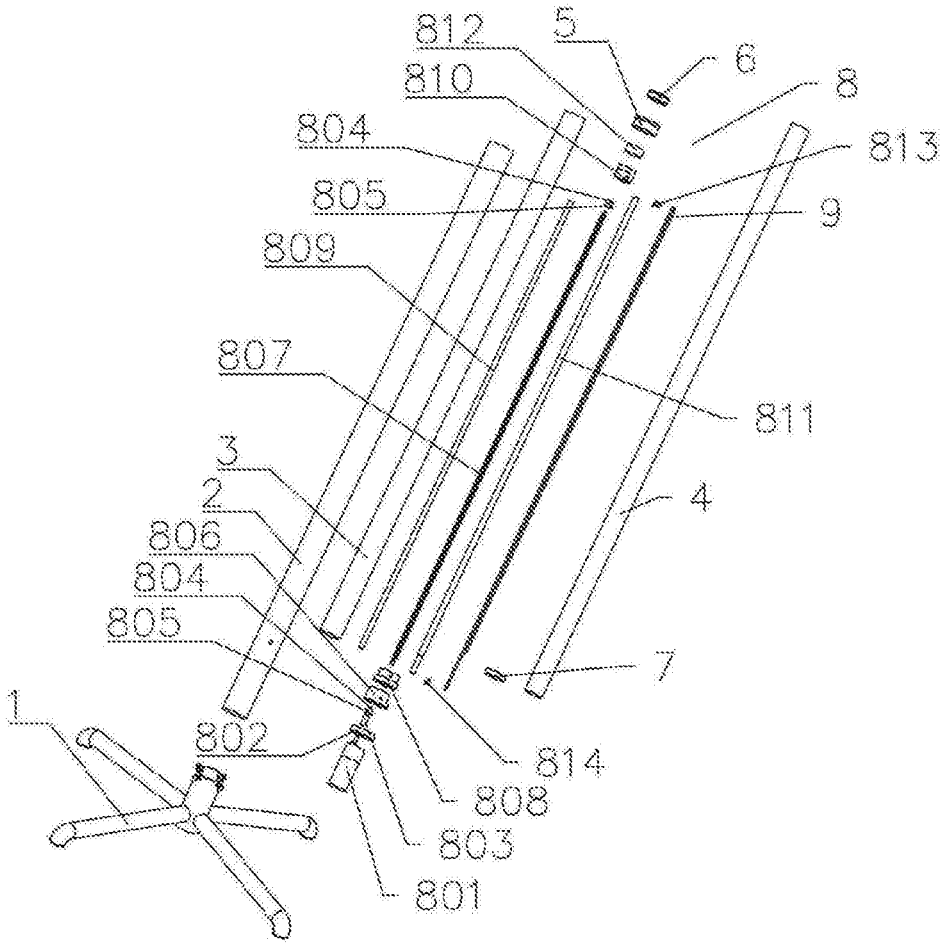
FIG. 2 is a disassembled schematic diagram of the three-joint linkage lifting device with built-in chain for Christmas tree in the present application.

As shown in FIG. 1 and FIG. 2, the embodiment of the present application is a three-joint linkage lifting device with built-in chain for Christmas tree, comprising a base 1 and a bracket fixed on the base. Importantly, the bracket comprises an outer tube 2, a middle tube 3, an inner tube 4, an upper fixing sleeve for the outer tube 5, an upper fixing sleeve for the middle tube 6, and a lower fixing sleeve for the inner tube 7, an electric lifting assembly 8, and a sliding hoisting rope 9, wherein the outer tube 2, the middle tube 3, and the inner tube 4 are all hollow rods, a bottom of the outer tube 2 is fixed on the base 1, and the upper fixing sleeve of the outer tube 5 is fixed on a top end of the outer tube 2, the middle tube 3 passes through the upper fixing sleeve for the outer tube 5 and is slidably fitted in a central cavity of the outer tube 2, the upper fixing sleeve for the middle tube 6 is fixed on a top end of the middle tube 3, and the inner tube 4 passes through the upper fixing sleeve for the middle tube 6 and is slidably fitted in a central cavity of the middle tube 3, and the lower fixing sleeve for the inner tube 7 is fixed at a lower end of the inner tube 4 and is slidably arranged on inner side of an inner wall of the cavity of the middle tube 3. The main function of the upper fixing sleeve for the outer tube, the upper fixing sleeve for the middle tube, and the lower fixing sleeve for the inner tube is to prevent shaking between the inner tube 4 and the middle tube 3 and between the middle tube 3 and the outer tube 2 when the middle tube 3 and the inner tube 4 are rising, and can prevent friction from causing abnormal noise;

A power part of the electric lifting assembly 8 is fixed on the inside of the bottom of the outer tube 2, a lifting stroke part of the electric lifting assembly 8 extends into the inside of the inner tube 4, and a bottom of the middle tube 3 is fixedly connected to the lifting stroke part of the electric lifting assembly 8, and the electric lifting assembly 8 is electrically connected to an external control power supply system; and the electric components are driven by the external power supply to run;

One end of the sliding hoisting rope 9 is fixed at a bottom of the electric lifting assembly 8, and the other end passes through a top end of the electric lifting assembly 8 and is folded back and fixed on middle and lower inner wall of the inner tube 4 after being resisted.

Through this design, the Christmas tree lifting bracket is configured to be an electric two-stage lifting bracket, and the components of the Christmas tree are sleeved outside the bracket, so that the Christmas tree bracket can be lifted and lowered by pushing the screw linear pushing device of the electric lifting assembly 8, at the same time, the sliding hoisting rope 9 is fixed on the electric lifting assembly 8, and when the middle tube 3 rises, the sliding hoisting rope 9 is jacked up to slide and pull up the inner tube 4 synchronously, so as to achieve the effect of double joint linkage and realize the synchronous lifting of the inner tube 4. Through this design, the lifting speed is faster, and the height and volume are smaller after being retracted, which is convenient for transportation and arrangement.

Wherein, more specifically, the electric lifting assembly 8 is a screw-rod linear pushing device. As long as it is a device that realizes linear thread pushing, it can be used, and the propulsion speed is not required, but the pushing force is required to be large enough to support the device parts of the Christmas tree.

Wherein, more specifically, the screw linear pushing device comprises a motor 801, a motor fixing plate 802, a coupling 803, a screw-rod clamp spring 804, a bearing 805, a screw-rod fixing plate 806, a screw rod 807, a screw-rod lifting plate 808, a fixing tube 809, an upper fixing plate 810, a lifting tube 811, a lifting plate 812, wherein an outer side of the motor fixing plate 802 is fixed on an inner side of a bottom end of the outer tube 2, the motor 801 is fixed in middle of the motor fixing plate 802, and a bottom of the screw-rod 807 is dynamically connected to a power output shaft of the motor 801 through the coupling 803.

An outer side of the screw-rod fixing plate 806 is fixed on an inner side of the bottom end of the outer tube 2, the upper fixing plate 810 is fixed on the screw-rod fixing plate 806 through the fixing tube 809, wherein after outer sides of an upper end and a lower end of the screw-rod 807 are respectively fixedly sleeved with bearing 805 and screw clamp spring 804, the lower end of the screw-rod 807 can be rotatably fixed on a middle part of the screw-rod fixing plate 806, and the upper end of the screw-rod 807 can be rotatably fixed on a middle part of the upper fixing plate 810.

An inner side of the screw-rod lifting plate 808 is provided with an internal thread corresponding to an external thread of the screw-rod 807, the screw-rod 807 passes through the screw-rod lifting plate 808 and is screwed with it, and an upper part of the screw-rod lifting plate 808 is fixedly connected with the bottom of the middle tube 3. The screw rod 807 rotates and pushes the screw-rod lifting plate 808 to rise and fall through the thread.

A bottom end of the lifting tube 811 is fixed on the screw-rod fixing plate 806, and an upper end passes through the upper fixing plate 810 and is fixedly connected with the lifting plate 811; one end of the sliding hoisting rope 9 is fixed on the screw-rod fixing plate 806, and the other end of the sliding hoisting rope 9 passes through the lifting tube 811, the upper fixing plate 810 and the lifting plate 812 and returns to the inner tube 4 and is fixed on middle and lower part of the inner tube 4. When the middle tube 3 on the screw-rod fixing plate 806 rises, the upper fixing plate 810 also rises, thereby pushing the end of the sliding hoisting rope 9 fixed on the inner side of the lower part of the inner tube 4 to pull up, thereby achieving the effect of double-joint linkage, and the inner tube 4 is synchronously raised.

Wherein, more specifically, the screw-rod linear pushing device also comprises an upper limit switch 813, a lower limit switch 814, wherein the upper limit switch 813 is fixed on a side of the upper fixing plate 810 facing downward, and the lower limit switch 814 is fixed on a side of the screw-rod fixing plate 806 facing upward and facing a bottom surface of the screw-rod lifting plate 808, the upper limit switch 813 is connected in series with the lower limit switch 814 through a wire passing through an inner cavity of the inner tube 4, and the motor 801 is connected in series with the upper limit switch 813 and the lower limit switch 814 and then electrically connected to the external control power supply system, thereby protecting the motor 801 and the lifting components and preventing excessive lifting and contraction.

Wherein, more specifically, the sliding hoisting rope 9 is a nylon rope, a steel wire rope or a chain.

The above is only an illustration of the embodiment of the present application, and is not intended to limit the present application. For those skilled in the art, any modification, equivalent replacement, improvement, etc. within the spirit and principles of the application without creative work shall be included in the protection scope of the present application.

What is claimed is:

1. A three-joint linkage lifting device with built-in chain for Christmas tree, comprising a base and a bracket fixed on the base, wherein the bracket comprises an outer tube, a middle tube, an inner tube, an upper fixing sleeve for the outer tube, an upper fixing sleeve for the middle tube, and a lower fixing sleeve for the inner tube, an electric lifting assembly, and a sliding hoisting rope, wherein the outer tube, the middle tube, and the inner tube are all hollow rods, a bottom of the outer tube is fixed on the base, and the upper fixing sleeve of the outer tube is fixed on a top end of the outer tube, the middle tube passes through the upper fixing sleeve for the outer tube and is slidably fitted in a central cavity of the outer tube, the upper fixing sleeve for the middle tube is fixed on a top end of the middle tube, and the inner tube passes through the upper fixing sleeve for the middle tube and is slidably fitted in a central cavity of the middle tube, and the lower fixing sleeve for the inner tube is fixed at a lower end of the inner tube and is slidably arranged on an inner side of an inner wall of the cavity of the middle tube;

a power part of the electric lifting assembly is fixed on the inside of the bottom of the outer tube, a lifting stroke part of the electric lifting assembly extends into the inside of the inner tube, and a bottom of the middle tube is fixedly connected to the lifting stroke part of the electric lifting assembly, and the electric lifting assembly is electrically connected to an external control power supply system;

one end of the sliding hoisting rope is fixed at a bottom of the electric lifting assembly, and the other end passes through a top end of the electric lifting assembly and is folded back and fixed on middle and lower inner wall of the inner tube after being resisted.

2. The three-joint linkage lifting device with built-in chain for Christmas tree according to claim 1, wherein the electric lifting assembly is a screw linear pushing device.

3. The three-joint linkage lifting device with built-in chain for Christmas tree according to claim 2, wherein the screw linear pushing device comprises a motor, a motor fixing plate, a coupling, a screw-rod clamp spring, a bearing, a screw-rod fixing plate, a screw rod, a screw-rod lifting plate, a fixing tube, an upper fixing plate, a lifting tube, a lifting plate, wherein an outer side of the motor fixing plate is fixed on an inner side of a bottom end of the outer tube, the motor is fixed in a middle of the motor fixing plate, and a bottom of the screw-rod is dynamically connected to a power output shaft of the motor through the coupling;

an outer side of the screw-rod fixing plate is fixed on the inner side of the bottom end of the outer tube, the upper fixing plate is fixed on the screw-rod fixing plate through the fixing tube, wherein after outer sides of an upper end and a lower end of the screw-rod are respectively fixedly sleeved with bearings and screw clamp springs, the lower and of the screw-rod can be rotatably fixed on a middle part of the screw-rod fixing plate, and the upper end of the screw-rod can be rotatably fixed on a middle part of the upper fixing plate;

an inner side of the screw-rod lifting plate is provided with an internal thread corresponding to an external thread of the screw-rod, the screw-rod passes through the screw-rod lifting plate and is screwed with it, and an upper part of the screw-rod lifting plate is fixedly connected with the bottom of the middle tube;

a bottom end of the lifting tube is fixed on the screw-rod fixing plate, and an upper end passes through the upper fixing plate and is fixedly connected with the lifting plate; one end of the sliding hoisting rope is fixed on the screw-rod fixing plate, and the other end of the sliding hoisting rope passes through the lifting tube, the upper fixing plate and the lifting plate and returns to the inner tube and is fixed on middle and lower part of the inner tube.

4. The three-joint linkage lifting device with built-in chain for Christmas tree according to claim 3, wherein the screw linear pushing device also comprises an upper limit switch, a lower limit switch, wherein the upper limit switch is fixed on a side of the upper fixing plate facing downward, and the lower limit switch is fixed on a side of the screw-rod fixing plate facing upward and facing a bottom surface of the screw-rod lifting plate, the upper limit switch is connected in series with the lower limit switch through a wire passing through an inner cavity of the inner tube, and the motor is connected in series with the upper limit switch and the lower limit switch and then electrically connected to the external control power supply system.

5. The three-joint linkage lifting device with built-in chain for Christmas tree according to claim 1, wherein the sliding hoisting rope is a nylon rope, a steel wire rope or a chain.

* * * * *